US010017965B2

(12) United States Patent
Wang

(10) Patent No.: US 10,017,965 B2
(45) Date of Patent: Jul. 10, 2018

(54) CHAIN LOCK

(71) Applicant: SINOX CO., LTD, New Taipei (TW)

(72) Inventor: Chia-Hung Wang, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 0 days.

(21) Appl. No.: 15/271,544

(22) Filed: Sep. 21, 2016

(65) Prior Publication Data

US 2017/0089100 A1 Mar. 30, 2017

(30) Foreign Application Priority Data

Sep. 25, 2015 (TW) ..... 104215605 U

(51) Int. Cl.

*E05B 67/00* (2006.01)
*E05B 73/00* (2006.01)
*E05B 67/28* (2006.01)

(52) U.S. Cl.

CPC ..... *E05B 67/003* (2013.01); *E05B 67/28* (2013.01); *E05B 73/0005* (2013.01)

(58) Field of Classification Search

CPC ..... E05B 37/08; E05B 47/0004; E05B 5/003; E05B 37/00; E05B 37/02; E05B 67/003; E05B 67/28; E05B 63/0017; E05B 37/0031; E05B 37/0068; Y10T 70/5872; Y10T 70/40; Y10T 70/435; Y10T 70/483; Y10T 70/5531

USPC ..... 70/30, 14, 49, 58

See application file for complete search history.

(56) References Cited

U.S. PATENT DOCUMENTS

| | | | |
|---|---|---|---|
| 1,369,308 | A | 2/1921 | Taylor |
| 1,718,723 | A | 6/1929 | Williams |
| 3,382,688 | A | 5/1968 | Wellekens |
| 5,913,906 | A | 6/1999 | Strocchi |
| 6,098,434 | A | 8/2000 | Liou |
| 6,386,005 | B1 | 5/2002 | Kuo |
| 6,711,921 | B1 | 3/2004 | Yang |
| 6,799,446 | B1 | 10/2004 | Tsai |
| 6,820,448 | B1 | 11/2004 | Hsieh |
| 7,185,518 | B1 | 3/2007 | Huang |
| 7,249,475 | B2 | 7/2007 | Yu |
| 7,437,898 | B2 | 10/2008 | Su |

(Continued)

FOREIGN PATENT DOCUMENTS

TW M350495 U 2/2009

OTHER PUBLICATIONS

Office Action dated Oct. 12, 2016 from related U.S. Appl. No. 15/240,093, 9 pages.

*Primary Examiner* — Suzanne L Barrett

(74) *Attorney, Agent, or Firm* — Innovation Capital Law Group, LLP; Vic Lin

(57) ABSTRACT

A chain lock is provided. The chain lock includes a lock body and a linkage chain. The lock body has a lock core and a lock body side surface. The linkage chain is formed via linking a plurality of link plates and has a first end and a second end. The first end is joined with the lock body. The second end can be inserted into a socket and secured by the lock core. The linkage chain can be wound around the lock body when the second end is unlocked, and wherein at least one of the plurality of link plates, except the link plates serving as the first end and the second end, engages the lock body side surface when the linkage chain is wound around the lock body.

20 Claims, 11 Drawing Sheets

(56) References Cited

U.S. PATENT DOCUMENTS

| | | | | |
|---|---|---|---|---|
| 7,481,084 | B1 | 1/2009 | Wu | |
| 7,712,339 | B2 | 5/2010 | Hentschel et al. | |
| 8,302,436 | B2 | 11/2012 | Cheung | |
| 8,555,682 | B2 | 10/2013 | Trunek | |
| 8,621,898 | B2 | 1/2014 | Chen | |
| 8,881,559 | B1 | 11/2014 | Chang | |
| 8,904,831 | B2 | 12/2014 | Stevens | |
| 9,217,265 | B2 | 12/2015 | Muller et al. | |
| 9,341,004 | B2 | 5/2016 | Elson | |
| 9,752,354 | B2 * | 9/2017 | Wang | E05B 67/003 |
| 2005/0044903 | A1 | 3/2005 | Ling et al. | |

* cited by examiner

CHAIN LOCK

BACKGROUND OF THE INVENTION

1. Field of the Invention

The present invention generally relates to a chain lock having a lock body and a linkage chain. More particularly, the present invention relates to a chain lock having a linkage chain wound around the lock body to reduce the volume of the chain lock.

2. Description of the Prior Art

Regarding locks, a U.S. Pat. No. 7,712,339 disclosed a joint rod lock, which includes a lock body and a joint bar hoop formed via linking a plurality of bars, and which can be folded together to reduce the volume thereof when collected. A Taiwan patent No. M350495 also disclosed a similar lock.

Compared with the conventional U-shape padlocks having a bulky volume, the abovementioned linkage locks indeed have the advantage of size reduction while being collapsed for storage. However, the abovementioned prior arts still have room for improvement. For example, the appearance of the collapsed locks should be taken into consideration in design in addition to volume reduction.

SUMMARY OF THE INVENTION

An object of the present invention is to provide a chain lock.

The chain lock of the present invention includes a lock body and a linkage chain. The lock body has a lock core and a lock body side surface. The linkage chain is formed via linking a plurality of link plates and has a first end and a second end. The first end is joined with the lock body. The second end can be inserted into a socket and secured by the lock core. The linkage chain can be wound around the lock body when the second end is unlocked. At least one of the plurality of link plates, except of the link plates serving as the first end and the second end, engages the lock body side surface when the linkage chain is wound around the lock body.

The chain lock of the present invention includes a lock body and a linkage chain. The lock body has a lock core. The linkage chain is formed via linking a plurality of link plates and has a first end and a second end. Each link plate has an inner side. The first end is joined with the lock body. The second end can be inserted into a socket and secured by the lock core. The linkage chain can be wound around the lock body when the second end is unlocked. The inner side of each link plate faces the lock body and at least one of the plurality of link plates, except the link plates serving as the first end and the second end, engages the lock body when the linkage chain is wound around the lock body The chain lock of the present invention includes a lock body and a linkage chain. The lock body has a lock core. The linkage chain is formed via linking a plurality of link plates and has two ends, wherein one of the two ends is joined with the lock body, wherein the other of the two ends can be inserted into a socket and secured by the lock core. At least one of the plurality of link plates, except of the link plates serving as the two ends, engages substantially the lock body side surface when the linkage chain is wound around the lock body.

The socket is disposed on the lock body side surface. The lock core has a latch. The second end has a positioning hole. The latch is able to prevent the second end from leaving the socket by passing through the positioning hole when the second end is inserted into the socket.

The latch is able to move in the lock body along a pivot direction of the lock body when the lock core is in an unlock-state. The movement of the latch in the lock body is restricted when the lock core is in a lock-state.

The lock core can be a key lock core or a combination lock core.

The link plates are pivotally linked. The link plates are pivotally linked one over one.

Accordingly, the chain lock of the present invention can be folded together to reduce the volume thereof when collected.

DETAILED DESCRIPTION OF THE PREFERRED EMBODIMENT

Figure 1:
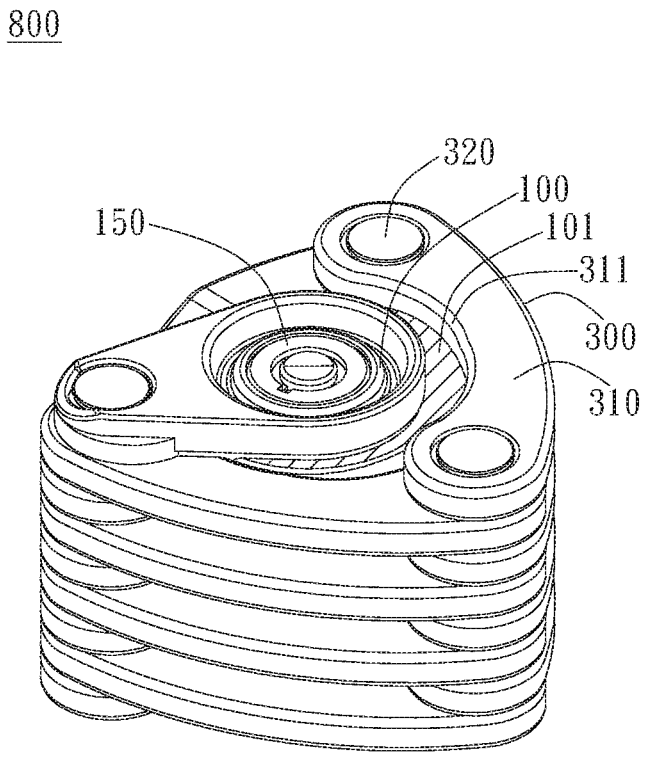
FIG. 1 is a schematic perspective view of the chain lock with the linkage chain wound around the lock body according to one embodiment of the present invention.
Figure 2:
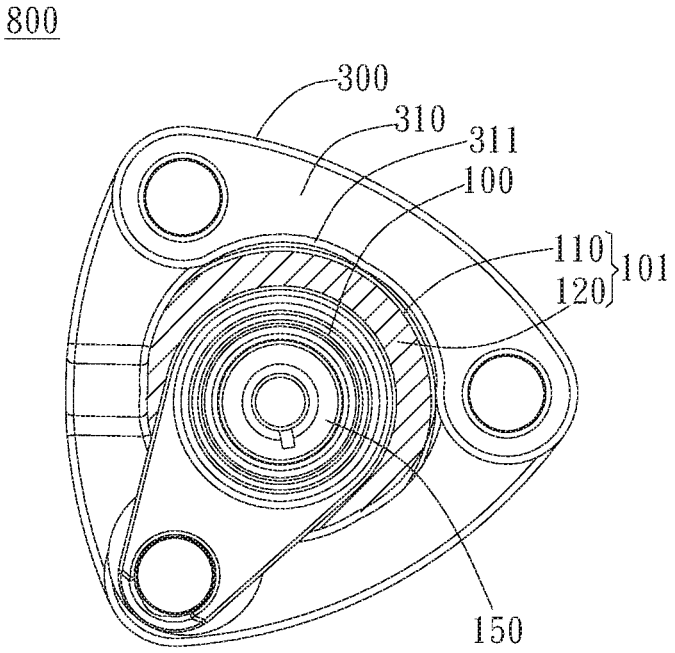
FIG. 2 is a schematic top view of the chain lock with the linkage chain wound around the lock body according to one embodiment of the present invention.
Figure 3:
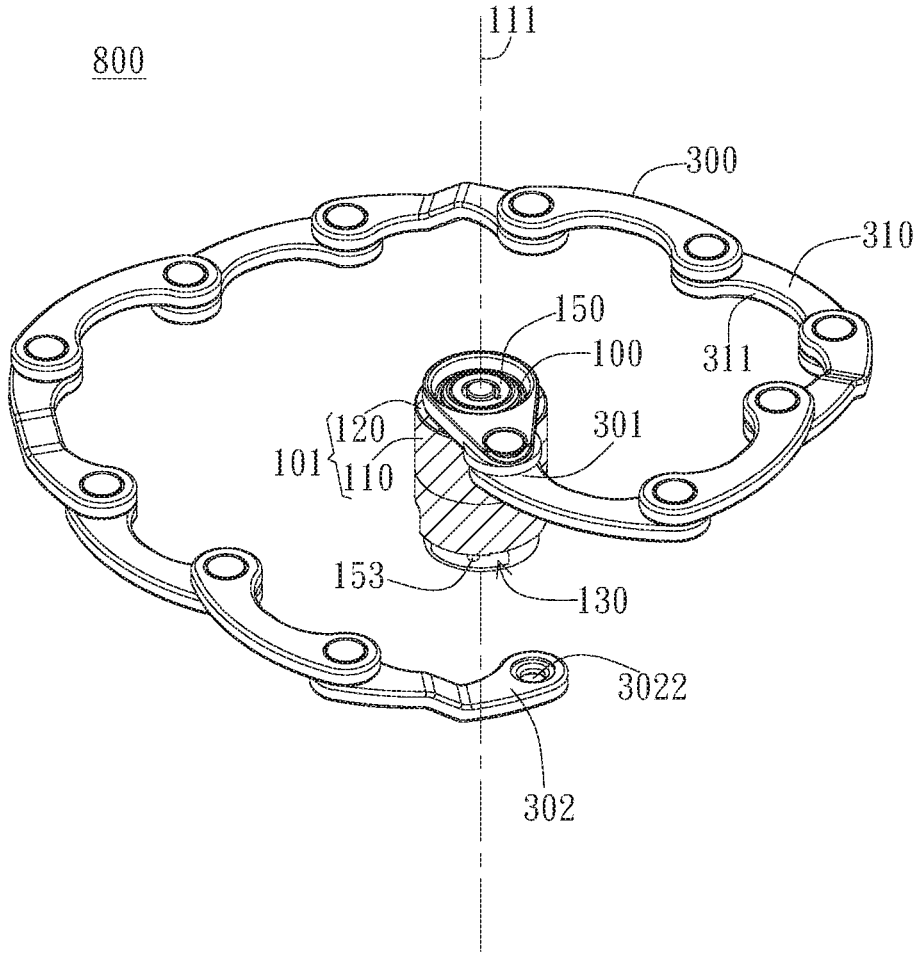
FIG. 3 is a schematic perspective view of the chain lock with the expanded linkage chain detached from the lock body according to one embodiment of the present invention.
Figure 4:
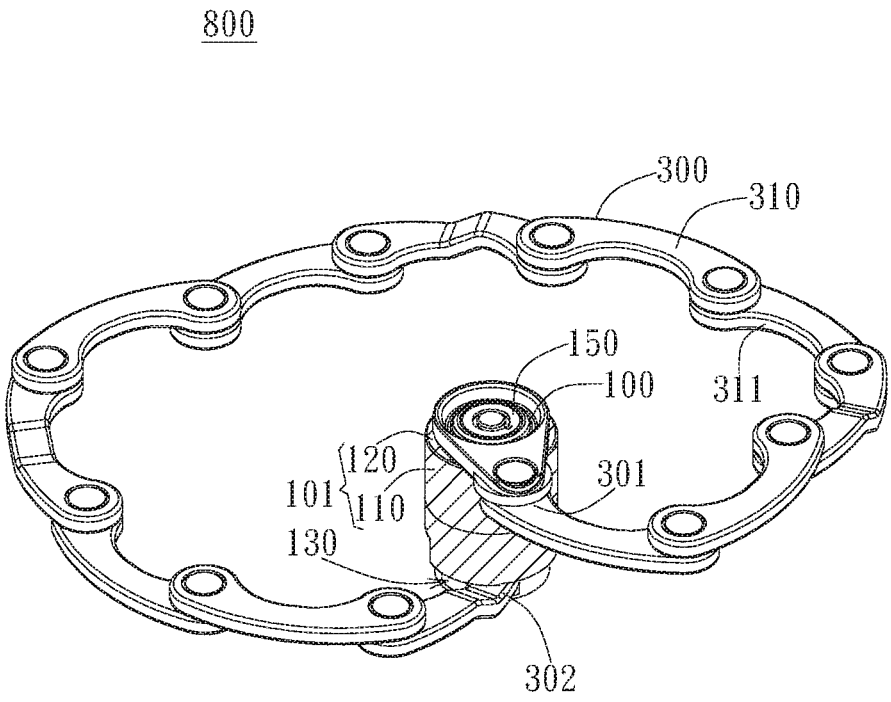
FIG. 4 is a schematic perspective view of the chain lock with the second end of the linkage chain inserted into the socket according to one embodiment of the present invention.

As the embodiments shown in FIGS. 1-4, the chain lock 800 of the present invention includes a lock body 100 and a linkage chain 300. The lock body 100 has a lock core 150 and a lock body side surface 110. The linkage chain 300 is formed via linking a plurality of link plates 310 and has a first end 301 and a second end 302. The first end 301 is joined with the lock body 100. As shown in FIGS. 3-4, the second end 302 can be inserted into a socket 130 and secured by the lock core 150. As shown in FIGS. 1-2, the linkage chain 300 can be wound around the lock body 100 to form a collected-shape occupying less space when the second end 302 is unlocked. The plurality of link plates 310, except the link plates 310 serving as the first end 301 and the second end 302, engages the lock body side surface 110 when the linkage chain 300 is wound around the lock body 100. More particularly, The plurality of link plates 310, except the link plates 310 serving as the first end 301 and the second end 302, leans on the lock body side surface 110 when the linkage chain 300 is wound around the lock body 100.Thus, the linkage chain 300 wound around the lock body 100 is much stable and less likely to expand. In a preferred embodiment, all link plates 310, except those serving as the first end 301 and the second end 302, engage the lock body side surface 110 when the linkage chain 300 is wound around the lock body 100. On the other hand, when the linkage chain 300 is wound around the lock body 100, the top face 120 of the lock body 100 is at least partially exposed. Thus, a user is able to check whether all link plates 310, except those serving as the first end 301 and the second end 302, engage the lock body side surface 110 from the side of the top face of the lock body 100.

From a different point of view, the linkage chain 300 is formed via linking a plurality of link plates 310. Each link plate 310 has an inner side 311. The inner side 311 of each link plate 310 faces the lock body 100 and all link plates 310, except those serving as the first end 301 and the second end 302, engage the lock body 100 when the linkage chain 300 is wound around the lock body 100. More particularly, the present invention does not constrain that the lock body 100 must have a smooth lock body side surface 110. Even though the lock body side surface 110 is irregular, with the inner side 311 engaging the lock body 100, the linkage chain 300 wound around the lock body 100 is still much stable and not likely to expand.

In other words, since the configuration of the linkage chain 300 wound around the lock body 100 is preferably achieved by making the inner side 311 engage the lock body 100, whether the lock body 100 having a regular or smooth lock body side surface 110 is not critical. The above technical effect can be achieved by the link plates 310, except those serving as the first end 301 and the second end 302, engaging substantially the lock body 100 when the linkage chain 300 is wound around the lock body 100.

Figure 5:
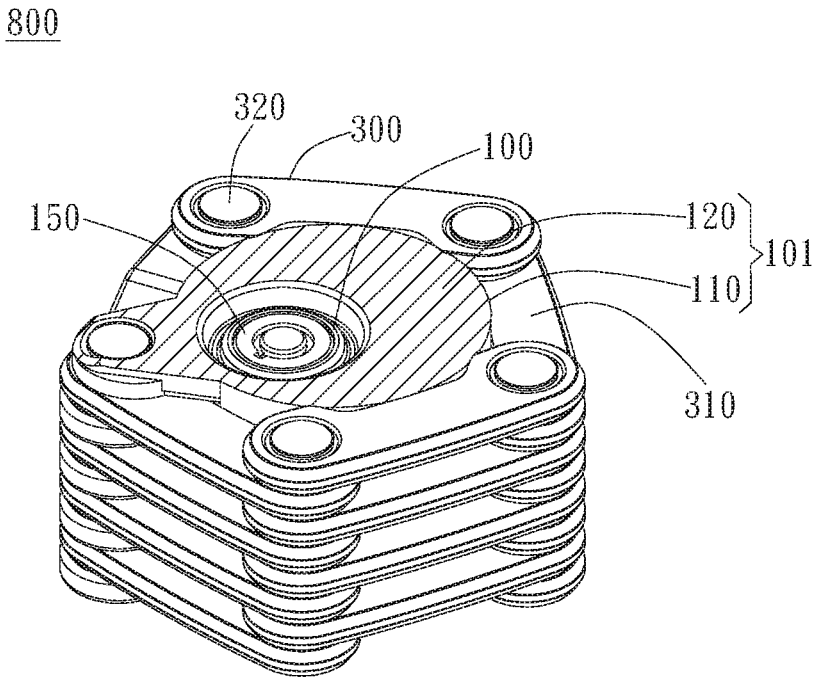
FIGS. 5-6 are schematic perspective and top views of the chain lock in a pentagonal column shape when the linkage chain is wound around the lock body, wherein the lock body is substantially a circular column shape.
Figure 6:
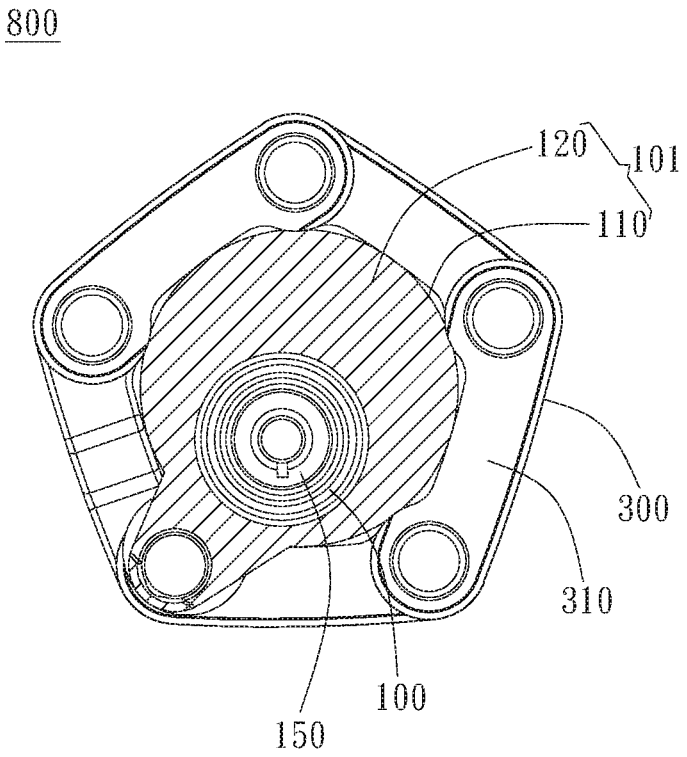
Figure 7:
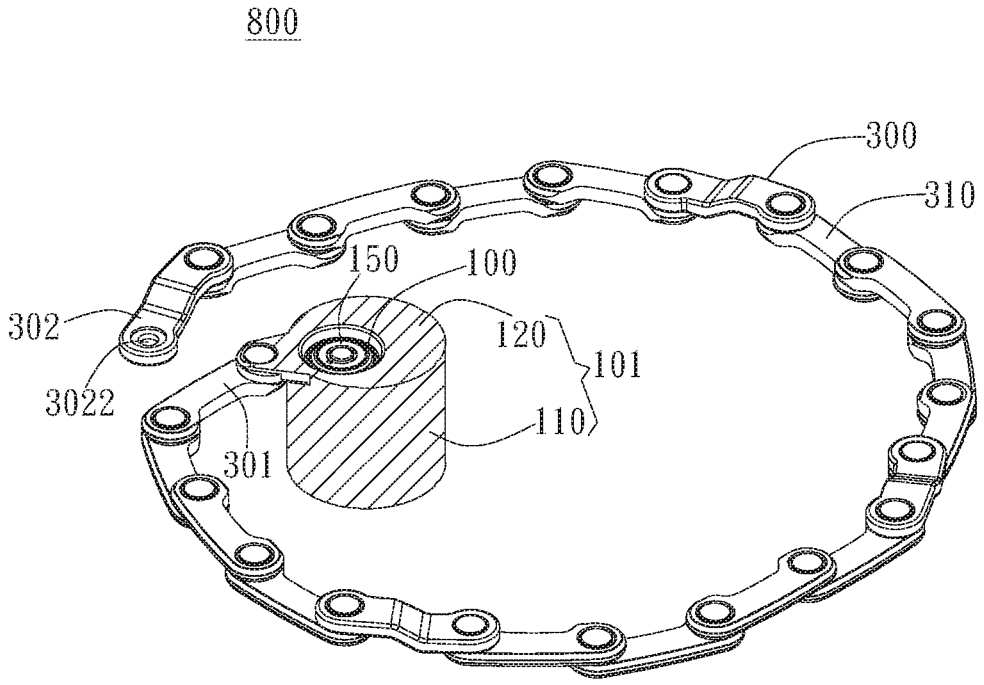
FIGS. 7-8 are schematic views showing the chain lock of FIG. 5 having the expanded linkage chain in unlocked and locked states, respectively.
Figure 8:
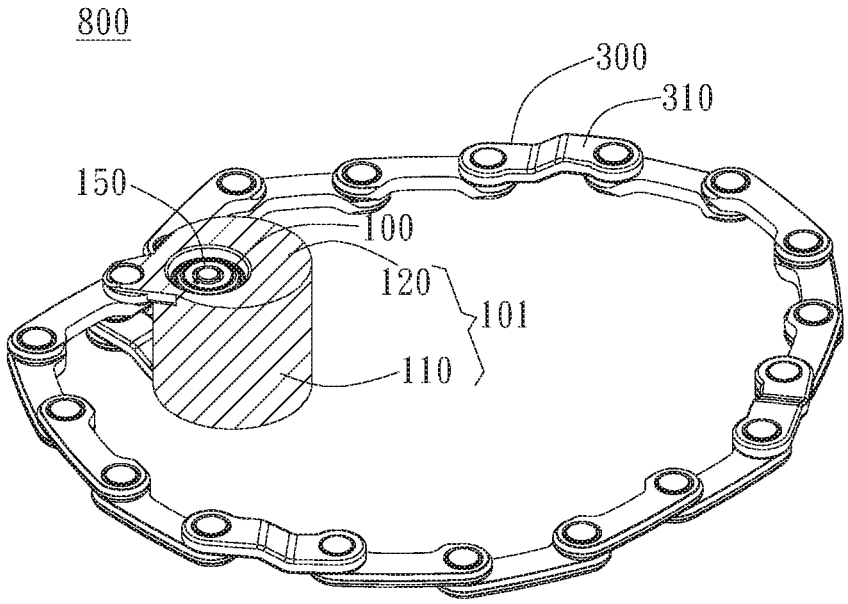
Figure 9:
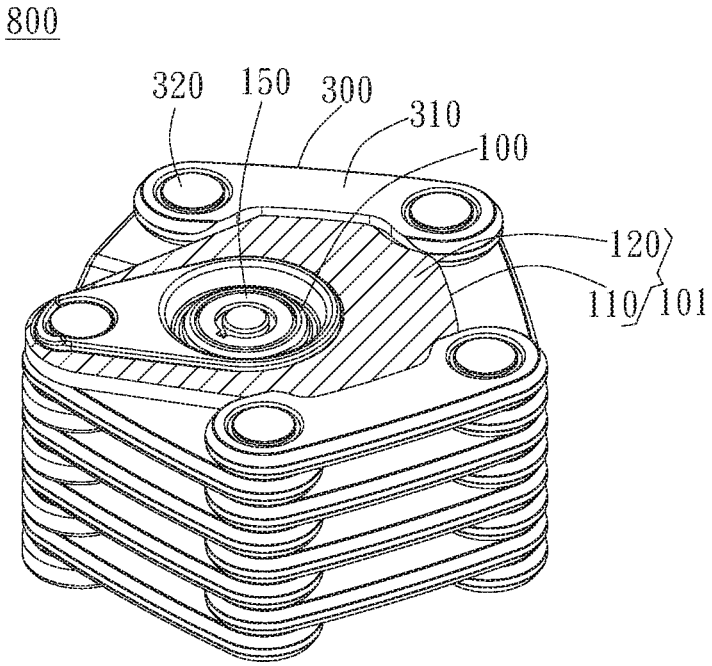
FIGS. 9-10 are schematic perspective and top views of the chain lock in a pentagonal column shape when the linkage chain is wound around the lock body, wherein the lock body is substantially a polygonal column shape.

In a preferred embodiment, the link plates 310 are pivotally linked to form the linkage chain 300. The link plates 310 are more preferably pivotally linked one over one with linking pivots 320, which is beneficial for the linkage chain 300 to be wound around the lock body 100, wherein the adjacent upper and lower linking pivots 320 align with each other when the linkage chain 300 is wound around the lock body 100, as shown in FIGS. 1,5, and 9.

As shown in FIG. 3, the lock core 150 has a latch 153. The latch 153 is able to move in the lock body 100 along a pivot direction 111 of the lock body 100 when the lock core 150 is in an unlock-state, e.g. the lock core 150 is unlocked by a user with a key for a key lock or with a correct unlock number for a combination lock. The movement of the latch 153 in the lock body 100 is restricted when the lock core 150 is in a lock-state. The above mentioned structure of lock core is well-known and no further description is provided here. On the other hand, as the embodiment shown in FIG. 3, the second end 302 has a positioning hole 3022. Hence, the lock core 150 is able to prevent the second end 302 from leaving the socket 130 by passing the latch 153 through the positioning hole 3022 when the second end 302 is inserted into the socket 130, as shown in FIG. 4. In this embodiment, the socket 130 is disposed on the lock body side surface 110. In a different embodiment, however, the socket 130 can be disposed on the lock body 100 other than the lock body side surface 110.

More particularly, in one embodiment, a user takes a chain lock 800 that the linkage chain 300 is wound around the lock body 100 and the lock core 150 is in the unlock-state as shown in FIGS. 1 and 2, unfolds or expands the linkage chain 300 as shown in FIG. 3, and passes through an object (e.g. a rim of a bike) to be locked. After that, as shown in FIG. 4, the second end 302 is inserted into the socket 130 and the lock core 150 is in the locked state to prevent the second end 302 from leaving the socket 130 and secure the second end 302 to the lock body 100 by passing the latch 153 through the positioning hole 3022. The user can use a key to unlock the lock core 150 and release the movement restriction of the latch 153. Hence, the latch 153 is able to leave the positioning hole 3022 and the second end 302 is able to leave the socket 130.

Figure 10:
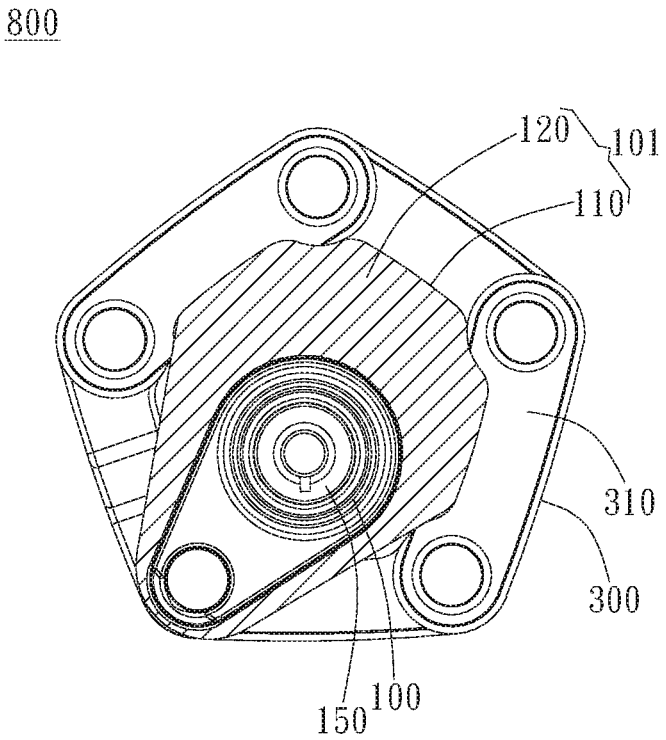
Figure 11:
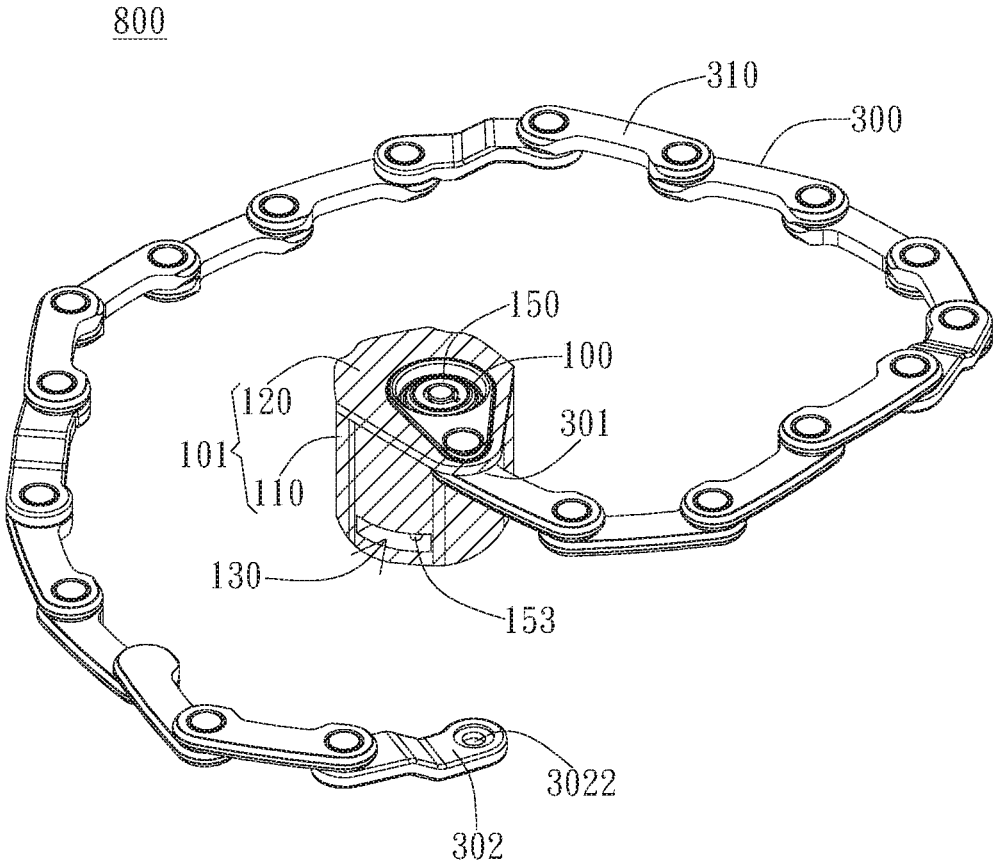
FIG. 11 is a schematic view showing the chain lock of FIG. 9 having the expanded linkage chain in unlocked state.

In the embodiments shown in FIGS. 1-4, the chain lock 800 presents substantially a triangular column shape when the linkage chain 300 is wound around the lock body 100. In other embodiments, however, the present invention does not constrain that the chain lock 800 must have a triangular column shape. For example, as the embodiments shown in FIGS. 5-8, the chain lock 800 presents a pentagonal column shape when the linkage chain 300 is wound around the lock body 100. In the embodiments shown in FIGS. 1-8, the lock body 100 is substantially a circular column shape. In other embodiments, however, the present invention does not constrain that the lock body 100 must have a circular column shape. For example, as the embodiments shown in FIGS. 9-11, the lock body 100 is substantially a polygonal column shape. In other words, the shape of the lock core 100 and the chain lock 800 when the linkage chain 300 is wound around the lock body 100 can be modified according to the manufacturing, design, and using requirements. When the linkage chain 300 is wound around the lock body 100, the top face of the lock body 100 is at least partially exposed. Thus, a user is able to check whether the link plates 310 engage the lock body side surface 110 from the side of the top face of the lock body 100.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A chain lock, comprising:

a lock body having a lock core, a top face, and a lock body side surface; and a linkage chain formed via linking a plurality of link plates with linking pivots and having a first end and a second end, wherein said first end is joined with said lock body, and wherein said second end can be inserted into a socket and secured by said lock core;

wherein said linkage chain can be wound around said lock body when said second end is unlocked, wherein the top face is at least partially exposed when the linkage chain is wound around the lock body, and wherein said plurality of link plates, except the link plates serving as said first end and said second end, engages said lock body side surface when said linkage chain is wound around said lock body, wherein the adjacent upper and lower linking pivots align with each other when said linkage chain is wound around said lock body.

2. The chain lock of claim 1, wherein said lock core is a key lock core.

3. The chain lock of claim 1, wherein said lock core is a combination lock core.

4. The chain lock of claim 1, wherein said link plates are pivotally linked.

5. The chain lock of claim 4, wherein said link plates are pivotally linked one over one.

6. The chain lock of claim 1, wherein said socket is disposed on said lock body side surface.

7. The chain lock of claim 1, wherein said lock core has a latch, wherein said second end has a positioning hole, wherein said latch is able to prevent said second end from leaving said socket by passing through said positioning hole when said second end is inserted into said socket.

8. The chain lock of claim 7, wherein said latch is able to move in said lock body along a pivot direction of said lock body when said lock core is in an unlock-state, wherein the movement of said latch in said lock body is restricted when said lock core is in a lock-state.

9. A chain lock, comprising:

a lock body having a lock core; and a linkage chain formed via linking a plurality of link plates with linking pivots and having a first end and a second end, wherein each link plate has an inner side, wherein said first end is joined with said lock body, wherein said second end can be inserted into a socket and secured by said lock core;

wherein said linkage chain can be wound around said lock body when said second end is unlocked, wherein a top face of the lock body is at least partially exposed when the linkage chain is wound around the lock body, wherein said inner side of each link plate faces said lock body and said plurality of link plates, except the link plates serving as said first end and said second end, engages said lock body when said linkage chain is wound around said lock body, wherein the adjacent upper and lower linking pivots align with each other when said linkage chain is wound around said lock body.

10. The chain lock of claim 9, wherein said lock core is a key lock core.

11. The chain lock of claim 9, wherein said lock core is a combination lock core.

12. The chain lock of claim 9, wherein said link plates are pivotally linked.

13. The chain lock of claim 12, wherein said link plates are pivotally linked one over one.

14. The chain lock of claim 9, wherein said lock core has a latch, wherein said second end has a positioning hole, wherein said latch is able to prevent said second end from leaving said socket by passing through said positioning hole when said second end is inserted into said socket.

15. The chain lock of claim 14, wherein said latch is able to move in said lock body along a pivot direction of said lock body when said lock core is in an unlock-state, wherein the movement of said latch in said lock body is restricted when said lock core is in a lock-state.

16. A chain lock, comprising:

a lock body having a lock core, a top face, and a lock body side surface; and a linkage chain formed via linking a plurality of link plates with linking pivots and having two ends, wherein one of said two ends is joined with said lock body, wherein the other of said two ends can be inserted into a socket and secured by said lock core;

wherein said plurality of link plates, except the link plates serving as said two ends, engages substantially said lock body side surface when said linkage chain is wound around said lock body, wherein the top face is at least partially exposed when the linkage chain is wound around the lock body, wherein the adjacent upper and lower linking pivots align with each other when said linkage chain is wound around said lock body.

17. The chain lock of claim 16, wherein said lock core is a key lock core.

18. The chain lock of claim 16, wherein said lock core is a combination lock core.

19. The chain lock of claim 16, wherein said link plates are pivotally linked.

20. The chain lock of claim 19, wherein said link plates are pivotally linked one over one.

* * * * *